US006702147B2

(12) United States Patent
Ashford

(10) Patent No.: US 6,702,147 B2
(45) Date of Patent: Mar. 9, 2004

(54) PERSONAL HYGIENE SUPPLY DISPENSER

(76) Inventor: Samantha Ashford, 45 Schindler Ter., West Orange, NJ (US) 07052

( * ) Notice: Subject to any disclaimer, the term of this patent is extended or adjusted under 35 U.S.C. 154(b) by 64 days.

(21) Appl. No.: 10/102,330

(22) Filed: Mar. 21, 2002

(65) Prior Publication Data

US 2003/0178436 A1 Sep. 25, 2003

(51) Int. Cl.[7] ..... B65H 1/00
(52) U.S. Cl. ..... 221/34; 221/97
(58) Field of Search ..... 221/33, 34, 46, 221/97; 206/216, 233, 499, 812; 312/34.4

(56) References Cited

U.S. PATENT DOCUMENTS

| | | | | |
|---|---|---|---|---|
| 2,007,042 A | * | 7/1935 | Duckett | 206/233 |
| 2,415,588 A | | 2/1947 | Gui | 206/38 |
| 2,841,275 A | | 7/1958 | Schwimmer et al. | 206/57 |
| 3,033,362 A | | 5/1962 | Marcalus | 206/57 |
| 3,072,245 A | | 1/1963 | Faltin | 206/19.5 |
| 3,095,087 A | | 6/1963 | Yates | 206/57 |
| 3,141,569 A | | 7/1964 | Hanson | 221/34 |
| 3,221,928 A | | 12/1965 | Horn | 221/34 |
| 3,331,498 A | | 7/1967 | Davies | 206/57 |
| 3,414,157 A | | 12/1968 | Wright | 220/23 |
| 3,458,095 A | | 7/1969 | Stall | 224/42.42 |
| 3,482,810 A | | 12/1969 | Bailey | 248/311 |
| 3,732,955 A | | 5/1973 | Carter et al. | 190/51 |
| 3,845,858 A | | 11/1974 | Jenkins | 206/233 |
| 4,483,440 A | | 11/1984 | Ware | 206/233 |
| 4,879,442 A | | 11/1989 | Giovine | 206/233 |
| 4,919,302 A | | 4/1990 | McPherson | 221/34 |
| 5,054,612 A | | 10/1991 | Meyer, Jr. | 206/233 |
| 5,505,296 A | | 4/1996 | Parker | 206/233 |
| 5,509,593 A | | 4/1996 | Bloch et al. | 225/37 |
| 5,542,566 A | | 8/1996 | Glaug et al. | 221/48 |
| 5,803,249 A | | 9/1998 | Harsanyi, Jr. et al. | 206/233 |
| 5,809,584 A | | 9/1998 | Potts | 4/254 |
| 6,081,943 A | | 7/2000 | Garcete | 4/476 |
| 6,189,730 B1 | * | 2/2001 | McClymonds | 221/46 |

FOREIGN PATENT DOCUMENTS

| | | | |
|---|---|---|---|
| JP | 5278767 | 10/1993 | B65D/83/08 |
| WO | WO 94/08500 | * 4/1994 | |

* cited by examiner

*Primary Examiner*—Kenneth W. Noland
(74) *Attorney, Agent, or Firm*—Ernest D. Buff & Associates, LLC; Ernest D. Buff; Gordon E. Fish

(57) ABSTRACT

A bedside butler unit dispenses hypoallergenic, antibacterial wet wipes and accommodates their disposal, following use. In one embodiment, the unit provides a safe, quick and discrete means for freshening up and readily disposing of clean-up materials. The unit is adapted to be placed on a vanity table or other easy to reach location near the bedside. It contains a sealed inner unit having a plurality of compartments. One of the compartments contains the hypoallergenic, antibacterial wet wipes, and another of the compartments serves as a disposal unit into which the wipes are conveniently placed after use. Additional compartments may be provided for dispensing dry wipes, and storing personal effects. In another embodiment, the unit is especially suited for use in hospitals, nursing homes and other patient care facilities to minimize the care provider's contact with soiled wipes, and thereby prevent the spread of infectious disease.

18 Claims, 8 Drawing Sheets

PERSONAL HYGIENE SUPPLY DISPENSER

BACKGROUND OF THE INVENTION

1. Field of the Invention

This invention relates to a unit for the dispensing and disposal of personal hygiene supplies; and more particularly, to a unit for dispensing pre-moistened personal hygiene wipes and, optionally, dry personal hygiene wipes, and for the sanitary disposal thereof.

2. Description of the Prior Art

The safe and convenient dispensing of personal hygiene items, and the disposal thereof after use, presents significant challenges, which are especially acute in a public or institutional settings such as hospitals, nursing homes and the like. In many cases, used items contain bodily fluids or wastes, and must therefore be handled carefully. In a medical facility, staff members handling these items may be exposed to contamination, with the result that infections or diseases may be inadvertently transmitted. Caregivers, such as those in nursing homes and daycare facilities, must regularly assist their clients when attending to their needs, often in situations of urgency. Owing to their age or medical condition, many of these clients may be particularly susceptible to contagion. The care needed by these clients requires frequent use of various wipes, tissues, and the like, which are then soiled and hence must be disposed in a safe, efficient, and aesthetically acceptable manner. Cleaning personnel are understandably averse to handling waste items, which may be unpleasant to touch and potentially harbor dangerous pathogens susceptible to transmission through inadvertent contact. Very stringent protocols are generally required in medical facilities, since infections tend to spread rapidly causing severe, potentially fatal, consequences. The possibility of infection extends even for home use, where convenient, sanitary disposal of used items remains important. Methods and means that facilitate safe, efficient, and cost-effective disposal of waste items with minimal possibility for contact are thus eagerly sought in each of these environments.

It has previously been proposed to combine dispensing and disposal functions that relate to personal hygiene. U.S. Pat. No. 2,007,042 to Duckett discloses a device for receiving used chewing gum. The device comprises a compartment for storing and dispensing inter-folded napkins and a receptacle. A user is thus encouraged to dispose of used gum by withdrawing a napkin, wrapping the gum in it, and depositing the wrapped gum into the receptacle.

U.S. Pat. No. 4,483,440 to Ware discloses a disposal device for gum and the like. The device has a generally cubical housing, a disposable bag removably supported therein, and appropriate access openings for gum disposal and bag removal. Each of the sidewalls of the housing is formed with a slot therein for the insertion of a sheet of advertising or other printed display material. The sidewalls are made of transparent or clear plastic material for viewing the display material. The housing includes a recess in one of the sidewalls for holding a packet of wrapping tissues for the sanitary disposal of spent chewing gum. A turntable supports the housing for rotation on a tabletop, such that the sidewall mounted tissues may be brought within reach, and the display panels may be viewed by several persons seated at the same table.

Systems for dispensing tissues and the like and disposing of them after use have also been proposed. U.S. Pat. No. 4,879,442 to Giovine discloses a receptacle for the selective removal of tissues and the storage of soiled tissues. Generally stated, the receptacle comprises a container having a first opening and a second opening. Each of the openings is disposed in opposite walls of the container. A movable partition is positioned within said container. Fresh clean tissues are positioned between the movable partition and one of the openings. A plastic bag waste receptacle is positioned between the movable partition and the second opening. The waste receptacle is positioned to expand to receive soiled tissues as fresh tissues are selectively removed from the first opening and thence deposited through the second opening into the waste receptacle.

U.S. Pat. No. 5,505,296 to Parker discloses a tissue container and disposal container arrangement. The disposal container is supplied in a collapsed condition in a cavity in the tissue container. In use, the disposal container is removed from the cavity and erected to form a container into which used tissues may be deposited. A tether is attached at one end to the disposal container; a fastener pad is attached to the other end to allow the disposal container to be positioned and secured for ease of access thereto and the disposal or emptying of its contents.

Systems have also been proposed for dispensing both pre-moistened and dry hygienic wipes. U.S. Pat. No. 5,509,593 to Bloch et al. discloses a combined wet and dry sanitary tissue dispenser. A rear housing cooperates with a front housing to allow the dispenser to be refilled periodically with supply rolls of both wet and dry tissues. The dispenser has a lock for securing the front housing to prevent theft of either the roll of dry sanitary tissue or the roll of prewetted personal hygiene wipes.

U.S. Pat. No. 5,803,249 to Harsanyi, Jr., et al., discloses a medical clean up kit comprising a container with multiple compartments for storing the clean up material. A first compartment dispensively houses a supply of moistened towelettes saturated with anti-pathogenic agents for destroying various viruses and bacteria. A second compartment dispensively houses a supply of dry towelettes. Various lids and closures are disclosed for sealing the compartments, and preventing the accidental spillage of anti-pathogenic agents that might precipitate from the moist towelettes.

None of the foregoing disclosures provides a dispensing unit having a tamper resistant disposal compartment. Even less do these disclosures facilitate disposal of used wipes using a method and means that avoids contact therewith by a caregiver, custodian, or the like.

Accordingly, there remains a need in the art for a method and means that enables the safe and convenient dispensing of hygienic wipes and facilitates their disposal after use.

SUMMARY OF THE INVENTION

The present invention provides a method and means for dispensing hypoallergenic, antibacterial wet wipes and accommodating disposal thereof, following their use. In one embodiment, the unit functions as a "Bedside Butler™" to provide a safe, quick and discrete means for freshening up and readily disposing of clean-up materials. The Bedside Butler™ is adapted to be placed on a vanity table or other easy to reach location near the bedside. It contains a sealed inner unit having a plurality of compartments. One of the compartments contains the hypoallergenic, antibacterial wet wipes, and another of the compartments serves as a disposal unit into which the wipes are conveniently placed after use. Additional compartments may be provided for dispensing dry wipes, and storing personal effects. In another embodiment, the unit is especially suited for use in hospitals, nursing homes and other patient care facilities to minimize the care provider's contact with soiled wipes, and thereby prevent the spread of infectious disease.

More specifically, there is provided, in accordance with the present invention, a unit for dispensing and disposing personal hygiene items. Such a unit comprises a housing having a top surface with a first housing dispensing aperture and a housing disposal aperture therein. The housing comprises a first dispensing container cavity and a disposal container cavity. A first dispensing container is removably disposed in the first dispensing container cavity. The first dispensing container has a first dispensing aperture therein that is substantially proximate and aligned with, and smaller in size than the first housing dispensing aperture. It is provided with a plurality of personal hygiene wipes adapted to be dispensed individually through the first dispensing aperture. A disposal container is removably disposed in the disposal container cavity. The disposal container is impervious. It has a tamper-resistant disposal aperture substantially proximate and aligned with, and smaller in size than the housing disposal aperture. The tamper-resistant aperture is adapted for disposal of spent personal hygiene wipes within the container.

Advantageously, the sealed inner unit is disposable and tamper resistant. Hygienic considerations are addressed and personal privacy is afforded. User concerns over contact with soiled wipes or invasion of privacy by tampering are alleviated.

BRIEF DESCRIPTION OF THE DRAWINGS

The invention will be more fully understood and further advantages will become apparent when reference is had to the following detailed description of the various embodiments of the invention and the accompanying drawings, wherein like reference numeral denote similar elements throughout the several views and in which.

DETAILED DESCRIPTION

The present invention is directed to a unit for the dispensing and sanitary disposal of personal hygiene items such as pre-moistened wipes. Generally stated, the unit comprises a housing having removable dispensing and disposal containers therein.

Figure 1:
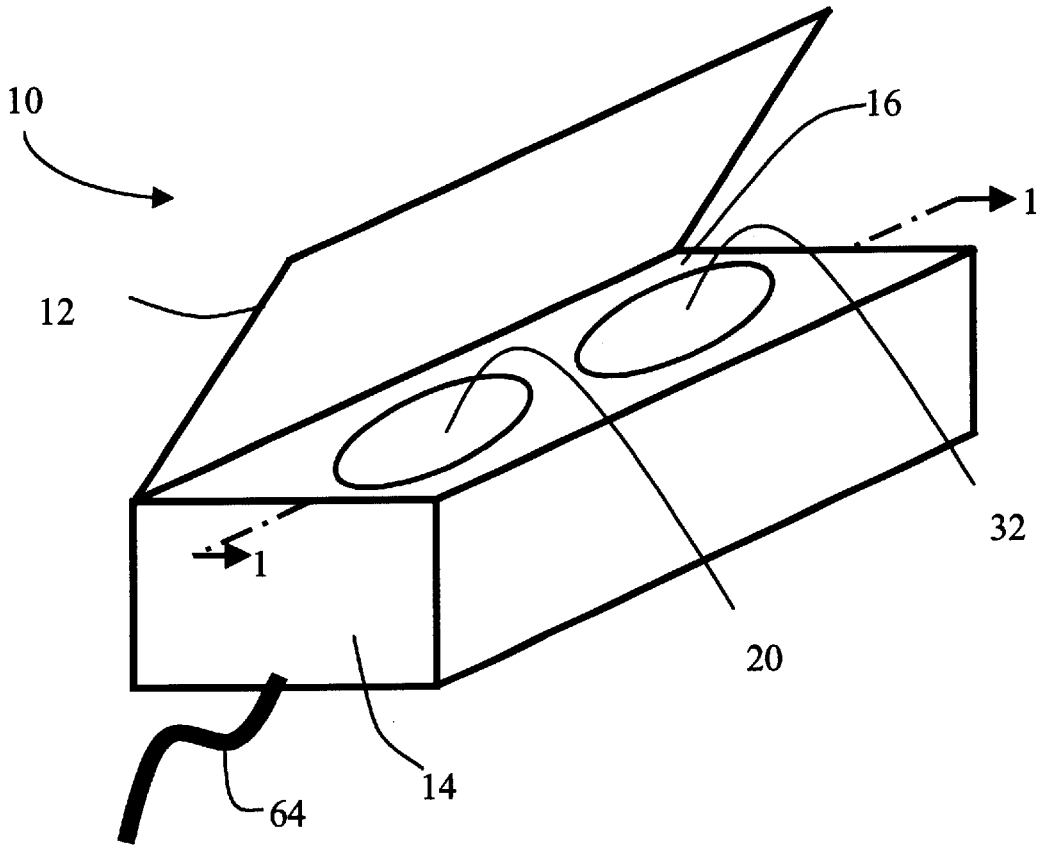
FIG. 1 is a perspective view of a unit for dispensing and disposal of personal hygiene items constructed in accordance with the present invention.

Referring now to FIG. 1, there is generally shown at 10 a unit for the dispensing and disposal of personal hygiene items. Unit 10 comprises housing 14 and an optional lid 12. Housing 10 may have the shape of a generally rectangular prism as depicted, or it may have an oval or other shape. As depicted, optional lid 12 is hingedly attached to one edge of the top surface 16 of housing 14. Alternatively, lid 12 may be fully detachable from housing 14 and may be adaptable to be inverted and thus to serve as a tray on which housing 14 may be rested when lid 12 is not in use as a closure for housing 14. Unit 10 may further comprise latch means (not shown) for securing lid 12 to housing 14.

Figure 2:
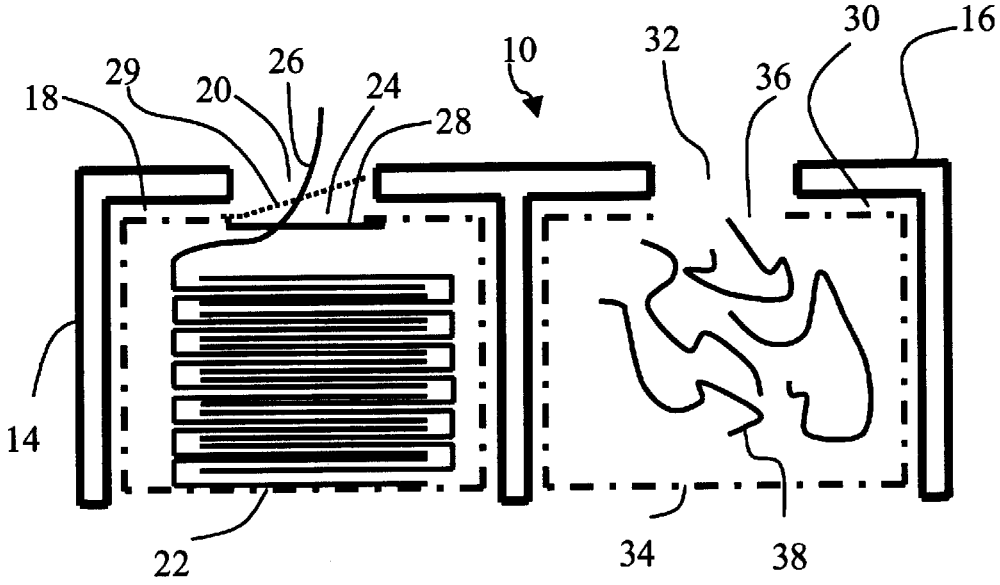
FIG. 2 is a longitudinal cross-section view of a unit for dispensing and disposal of personal hygiene items comprising a housing having dispensing and disposal containers disposed therewithin, the cross-section being taken along lines 1—1 of FIG. 1.

As depicted in FIG. 2, unit 10 further comprises a first dispensing container cavity 18 and a disposal container cavity 30 within housing 14. Top surface 16 of housing 14 has a first housing dispensing aperture 20 communicating with first dispensing container cavity 18 and a housing disposal aperture 32 communicating with disposal container cavity 30. First dispensing container 22 having first dispensing aperture 24 is removably disposed in first dispensing container cavity 18. First dispensing aperture 24 is substantially proximate and aligned with first housing dispensing aperture 20. A plurality of single-use, pre-moistened, personal hygiene wipes 26 are provided in first dispensing container 22. Wipes 26 may be removed individually by the user from first dispensing container 22 by extraction through first dispensing aperture 24, which is preferably at least slightly smaller than first housing dispensing aperture 20 to facilitate extraction of wipes 26. As illustrated, wipes 26 are provided in a conventional inter-folded manner, such that the removal of one wipe advances the next wipe into first dispensing aperture 24 to make it conveniently available for the next use. Alternatively (not shown), wipes 26 may be supplied from a roll, wherein individual wipes are defined by a line of serrations extending transversely of the roll. Preferably a flexible blocking means 28 attached to the inner surface of first dispensing container 22 and partially obstructing aperture 24 is provided to facilitate the dispensing of sheets 26 individually. Such a blocking means 28 also serves to hold a fresh sheet in position ready to be extracted by the user. As each sheet is withdrawn, the succeeding sheet is reliably drawn into position and frictionally held in readiness for the next use. Blocking means 28 may take any form known for the packaging of sheet goods, including (i) a pair of substantially coplanar plastic strips disposed adjacently so as to form a narrow slot between the strips and (ii) a plurality of flexible wedge-shaped flaps. Closure 29 (shown in the open position by FIG. 2) is optionally provided to hermetically seal container 22, thereby reducing evaporation and extending the shelf life of wipes 26. Although a flap-type closure 29 is depicted in FIG. 2, other forms of closure are also contemplated by the present invention, including snap lids, threaded lids, and re-sealable adhesive lids. Each of blocking means 28 and closure 29 also acts to inhibit any potential contamination of remaining sheets 26 from external sources.

Dispensing container 22 is composed of any suitable impervious material compatible with pre-moistened wipes 26, including plastics and coated paper and cardboard materials known in the packaging art. Alternatively, dispensing container may be made impervious by provision of a separate impervious liner that prevents seepage of moisture from pre-moistened wipes.

A warming element 62 may optionally be provided in dispensing container cavity 18 for gently warming pre-moistened wipes 26 to a temperature comfortable for their use. Warming element 62 may be energized by connection to a source of household electrical current through power cord 64.

Figure 3:
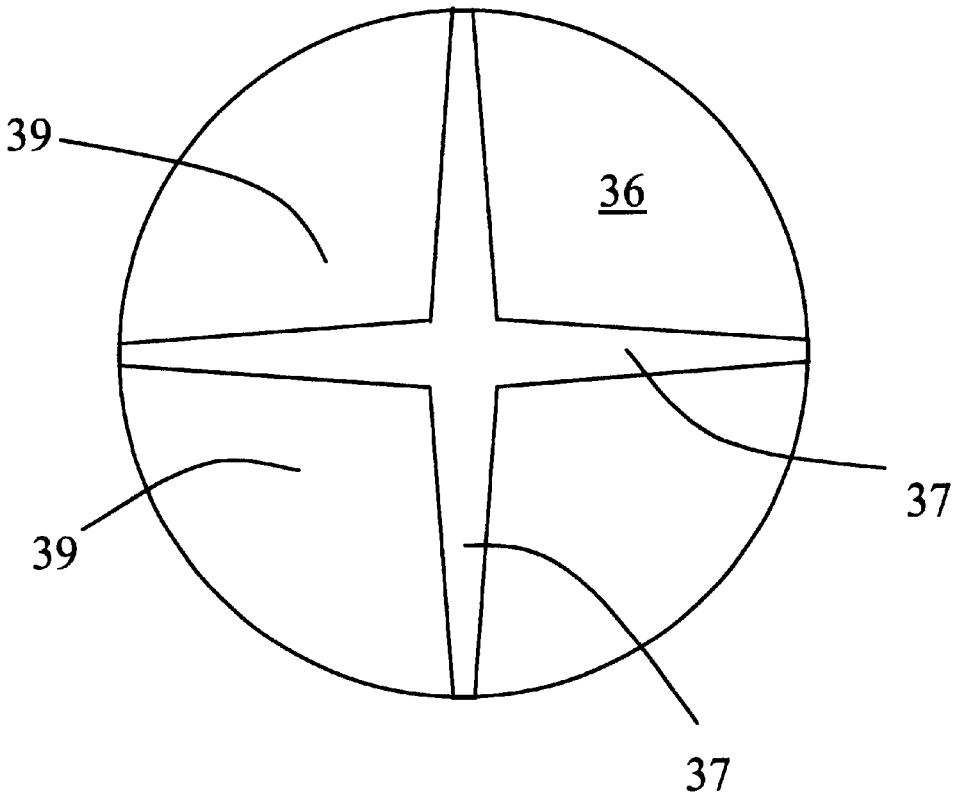
FIG. 3 is a plan view of a tamper-resistant disposal aperture of the disposal container shown in FIG. 1.
Figure 4:
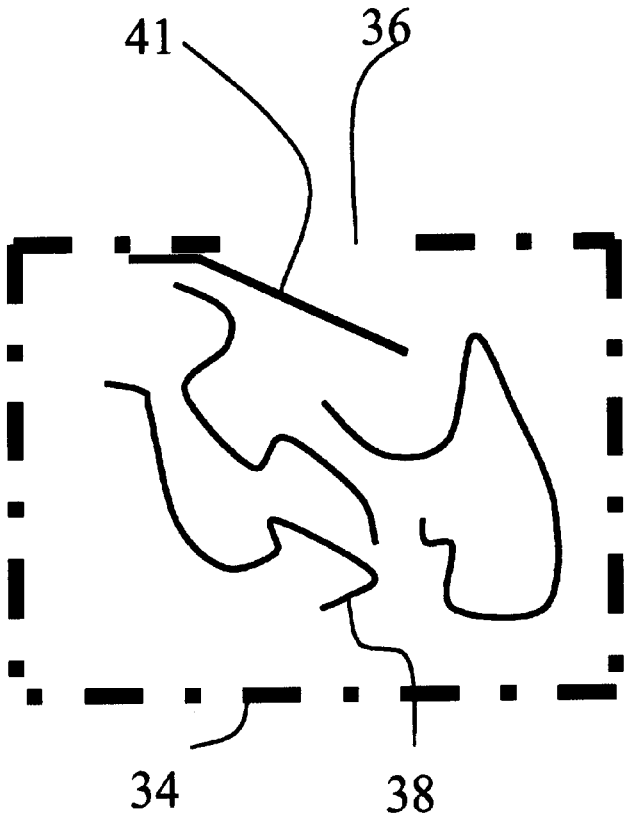
FIG. 4 is a cross-sectional view of one form of the disposal container comprising a tamper resistant aperture in accordance with the invention.

Disposal container 34 comprising disposal aperture 36 is removably disposed in disposal container cavity 32. Disposal aperture 24 is substantially proximate and aligned with, housing disposal aperture 20. Disposal container 34 is appointed for the sanitary disposal of spent wipes 38 through disposal aperture 36. Preferably disposal aperture 36 is at least slightly smaller than housing disposal aperture 32 to facilitate disposal of spent wipes 38 and to lessen the chance of transferring unwanted material from spent wipes 38 onto housing 14, especially at housing disposal aperture 32. Preferably, disposal aperture 36 is tamper-resistant. One form of tamper-resistant disposal aperture 36, illustrated in FIG. 3, is generally circular and formed by cutting a plurality of crossed slots 37 in the wall of disposal container 34 to leave a plurality of generally wedge-shaped barbs 39. Although two slots of substantially the same length are illustrated in FIG. 3, a larger number of slots may be used. Preferably the slots are of substantially similar length and uniformly disposed so their centers are substantially coincident. Barbs 39 inhibit the removal of objects from disposal container 34. An alternative tamper-resistant aperture is shown by FIG. 4. It comprises a flap 41 hingedly connected to the inside surface of disposal container 34. The flap is openable downward into the interior volume of disposal container 34, as illustrated by FIG. 4. In the closed position (not shown) flap 39 at least partially covers disposal aperture 36. Flap 41 inhibits the removal of objects from disposal container 34. Other known forms of tamper-resistant aperture may also be used. A tamper-resistant aperture is preferred for the present invention, as it significantly reduces the prospect that a caregiver, cleaning person, subsequent user, or another person in the vicinity of the disposal compartment may inadvertently come into contact with a spent wipe 38, on which bodily fluid or waste is likely present. As a result, with use of tamper-resistant aperture 36, the chance for spread of infection is minimized. Disposal container 34 may be composed of a suitable plastic, such as polypropylene, nylon or PTFE, wood, or the like.

Figure 5:
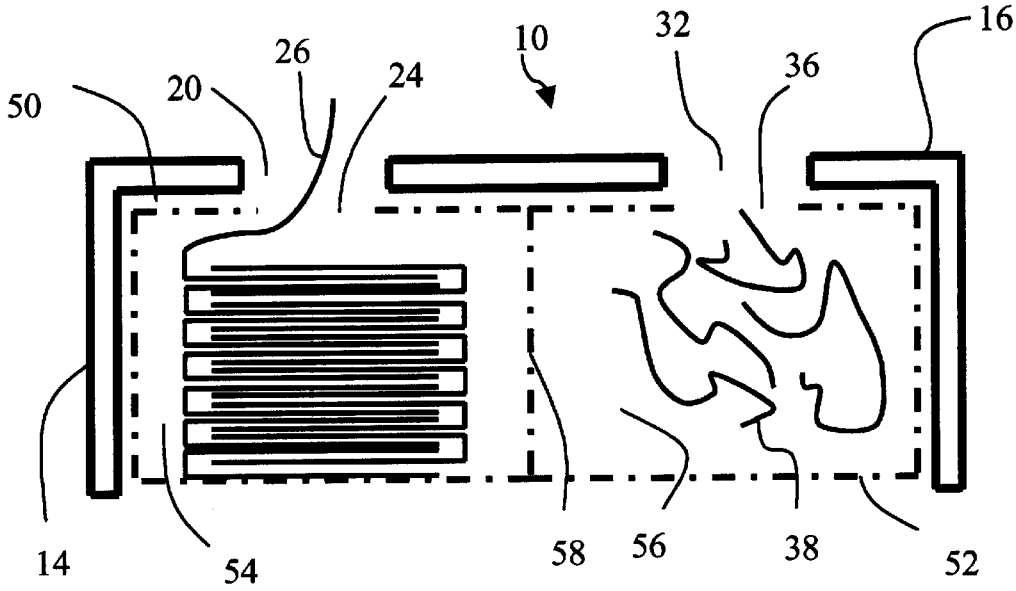
FIG. 5 is a perspective view of a unit for dispensing and disposal of personal hygiene items constructed in accordance with the present invention in which a dispensing container and a disposal container are joined in a single assembly.

In a further embodiment of the invention, illustrated by FIG. 5, dispensing container 22 and disposal container 34 are joined in a single self-supporting assembly 52 having a dispensing compartment 54 and a disposal compartment 56 separated by an impervious barrier 58. For use in this embodiment, housing 14 has a single housing cavity 50 in which assembly 52 is removably disposed. Such an arrangement advantageously allows the re-supply of fresh wipes and disposal of the spent wipes to be accomplished in a single operation by exchange of assembly 52. This means of servicing may be of particular utility in the context of a medical facility or other similar setting. Protocols in these settings often require that each client be furnished individually with personal hygiene items appointed for use exclusively for that individual's needs. An important feature of the present invention is its ability to facilitate this segregation and safe handling of fresh and spent materials.

Figure 6:
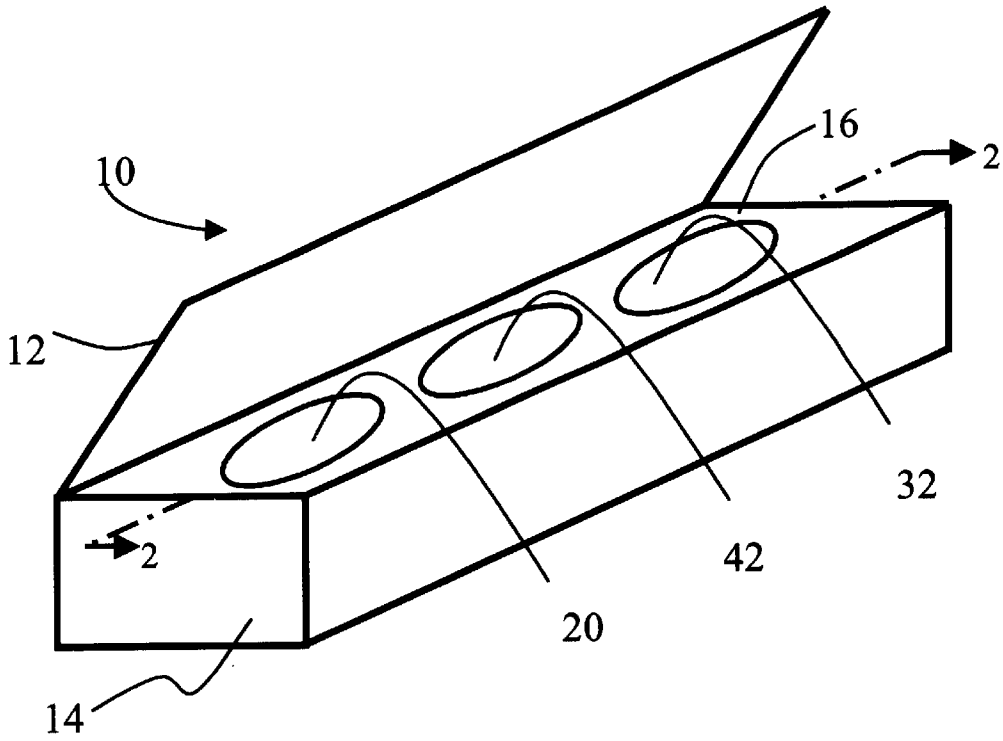
FIG. 6 is a perspective view of a unit for dispensing and disposal of both pre-moistened and dry personal hygiene items constructed in accordance with the present invention.
Figure 7:
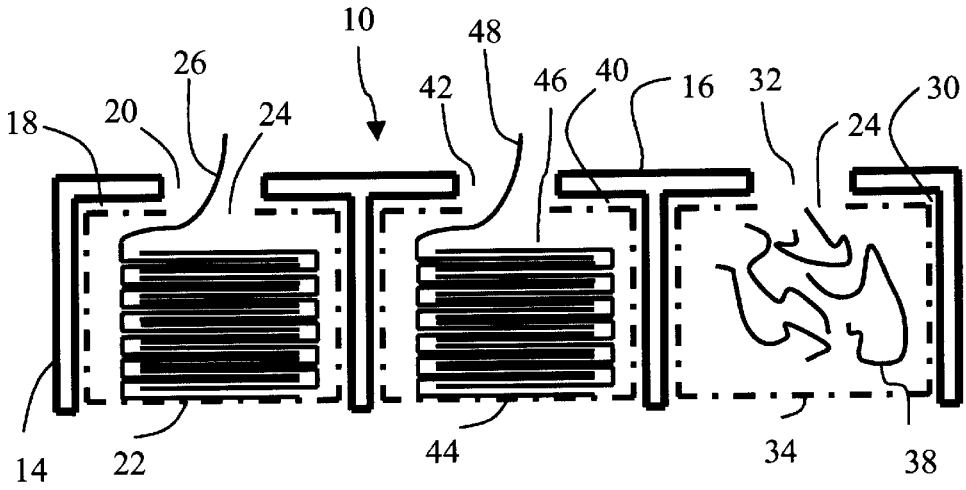
FIG. 7 is a longitudinal cross-section view of a unit for dispensing and disposal of personal hygiene items comprising a housing having first and second dispensing containers and a disposal container therewithin, the cross-section being taken along lines 1—1 of FIG. 6.

In another aspect of the invention, illustrated by FIGS. 6 and 7, unit 10 is appointed for the dispensing of personal hygiene wipes from two source containers. As best shown by FIG. 6, top surface 16 of housing 14 has a first housing dispensing aperture 20 communicating with first dispensing container cavity 18, a second housing dispensing aperture 42 communicating with second dispensing container cavity 18, and a housing disposal aperture 32 communicating with disposal container cavity 40. As shown by FIG. 7, first dispensing container 22, having first dispensing aperture 24, is removably disposed in first dispensing container cavity 18. First dispensing aperture 24 is substantially proximate and aligned with, first housing dispensing aperture 20. A plurality of single-use, pre-moistened, personal hygiene wipes 26 are provided in first dispensing container 22. Flexible blocking means 28 and closure 29 are preferably provided for first dispensing container 22. Second dispensing container 44 having second dispensing aperture 46 is removably disposed in second dispensing container cavity 40. Second dispensing aperture 46 is substantially proximate and aligned with, second housing dispensing aperture 42. A plurality of single-use, dry, personal hygiene wipes 48 are provided in second dispensing container 44. Flexible blocking means (not shown) similar to that appointed for first dispensing container 22 may also be provided for second dispensing container 44. A closure may also be provided for second dispensing container 44. Wipes 48 may be removed individually by the user from second dispensing container 44 by extraction through second dispensing aperture 46, which is preferably at least slightly smaller than second housing dispensing aperture 42 to facilitate extraction of wipes 48. As illustrated, wipes 48 are provided in a conventional inter-folded manner, such that the removal of one wipe advances the next wipe into aperture 46 to make it conveniently available for the next use. Alternatively (not shown), wipes 48 may be supplied from a roll, wherein individual wipes are defined by a line of serrations extending transversely of the roll.

It will be appreciated by those skilled in the art that unit 10 may be readily equipped to dispense such products as wipes, tissues, and the like, as well as other products in sheet form, by the inclusion of further cavities and dispensing apertures in housing 14. Exemplary products that may be dispensed include perfume strips, eyeglass cleaning tissues, napkins, cotton swabs, and the like.

Furthermore, it will be appreciated that while FIG. 7 illustrates a unit appointed for dispensing different products from respective containers 22 and 44, i.e., pre-moistened and dry wipes, the same product may be dispensed from both portions of the unit. This arrangement advantageously allows one dispensing container to be held in reserve to assure a continuous supply of wipes when the other container is exhausted and replenishment has not yet occurred.

In still another aspect, housing 16 comprises additional features, including at least one storage compartment in which other personal effects or toiletries may be placed for safekeeping and convenient access. Lid 12 may also comprise one or more storage compartments.

The likelihood of proper disposal of used personal hygiene items is enhanced by the features of the present unit, which provide convenient, discreet disposal means proximate the location at which the items are supplied and used. In addition, combining, in a single, disposable unit, the source of the hygiene items and a means for their disposal after use enhances the efficiency of operating an institutional facility, as custodial staff may, in one operation, replenish the supply of new items and safely remove those already used.

The dispensing containers of the invention are provided with a plurality of sheets of personal hygiene wipes. The wipes may be packaged in ways known in the art. As noted hereinabove, in one form of packaging, each of the dispensing compartments 54 contains a plurality of folded fresh sheets that substantially conform to the dimensions of dispensing compartment 54. Sheets are positioned within the dispensing compartment 54 such that they can be selectively extracted through the aperture in the upper surface of the respective dispensing container. The aperture can have a variety of shapes but often is round or oval in aspect. Individual sheets may be present and folded in interlock, such that when one sheet is extracted through the aperture, another sheet is raised into the aperture or slit, positioning it in readiness for convenient extraction when next desired by the user.

In another form of packaging, the sheets are disposed on a roll with transverse serrations that define individual sheets. The outside end of the roll is threaded through the aperture to allow removal of individual sheets. As sheets are extracted, the roll unwinds and each sheet, in turn, is removed by tearing it along the serrations in the conventional way.

In still another form of packaging, sheets are also disposed on a roll with transverse serrations, but the sheets are fed from the inside side of the roll. The operability of this construction is facilitated by provision of an aperture defined by crossed slits in the top of the sealed inner unit.

In one aspect of the invention, each of the pre-moistened personal hygiene sheets provided in dispensing compartment 54 further comprises an agent that endows the sheet with antibacterial, antiviral, antimicrobial, or antipathogenic capabilities. Any agent known in the art to have such properties and to be compatible with application to human skin and mucous membranes may be used. It is preferred that the constituents of the pre-moistened sheet be hypoallergenic.

Housing 10 of the invention may be composed of a variety of materials. Wood and wood-based materials may be used and provide a decorative, aesthetically pleasing appearance. Rigid or semi-rigid plastics may be used for ease of cleaning and possibly sterilization. Metal, preferably stainless steel, may also be used for durability and ease of cleaning and repeated sterilization. The housing may be fabricated by assembly of individual component pieces or by casting, molding, or stamping using any known technique.

In the aspects of the invention depicted in FIGS. 1 and 6, housing 14 is appointed to rest directly on a table or similar surface, so that containers 22, 44, 34, or 52 are constrained to remain inside respective cavities 18, 40, 30, and 50 by cooperation of housing 14 and the surface on which the unit rests. Alternatively, unit 10 may further comprise a bottom openably connected to housing 14. The bottom may be hinged or fully detachable, either form allowing insertion and removal of the dispensing and disposal containers. The bottom may be affixed to housing 14 by any suitable snap fit or separate latching means or it may slidably engage grooves provided in housing 14. A locking means may be provided to secure the bottom to housing 14, thereby discouraging unauthorized removal of either dispensing or disposal containers.

Figure 8:
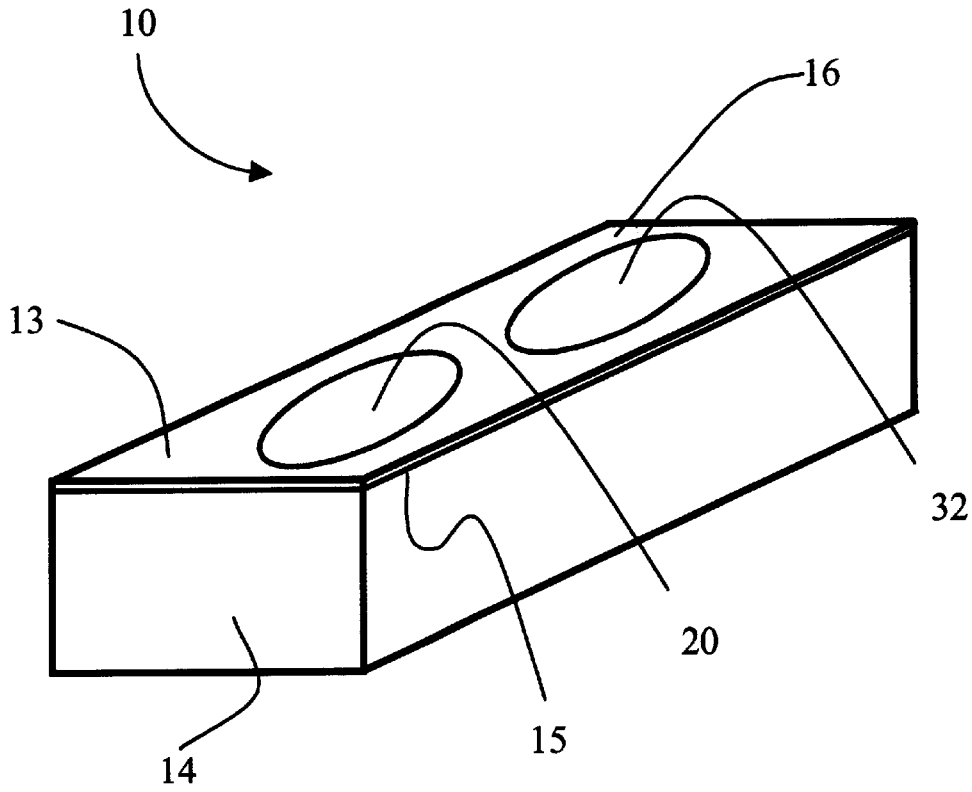
FIG. 8 is a perspective view of a unit for dispensing and disposal of personal hygiene items comprising a removable top.

In FIG. 8 there is shown a further aspect of the invention. In the embodiment shown, top surface 16 of housing 14 comprises removable top 13. Preferably, top 13 is attached to the remainder of housing 14 by a snap fit at joint line 15. In this aspect, housing 14 preferably has a solid bottom that is adjacent the surface on which unit 10 is placed. The solid bottom further acts to define the bottom of the cavities in which dispensing and disposal containers are placed.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A unit for dispensing and disposing personal hygiene items comprising:

i) a housing having a top surface with a first housing dispensing aperture and a housing disposal aperture therein, said housing comprising a first dispensing container cavity and a disposal container cavity;

ii) a first dispensing container removably disposed in said first dispensing container cavity, said first dispensing container having a first dispensing aperture therein that is substantially proximate and aligned with, and smaller in size than said first housing dispensing aperture, and being provided with a plurality of personal hygiene wipes adapted to be dispensed individually through said first dispensing aperture; and iii) a disposal container removably disposed in said disposal container cavity, said disposal container being impervious and having a tamper-resistant disposal apertute substantially proximate and aligned with, and smaller in size than said housing disposal aperture, and being adapted for disposal therein of spent personal hygiene wipes.

2. A unit as recited by claim 1, wherein said housing further comprises a second dispensing cavity; a second housing aperture in said top surface of said housing; and a second dispensing container removably disposed in said second dispensing container cavity, said second dispensing container having a second dispensing aperture therein that is substantially proximate and aligned with, and smaller in size than said second housing dispensing aperture, and being provided with a plurality of dry personal hygiene wipes adapted to be dispensed individually through said second dispensing aperture.

3. A unit as recited by claim 1, wherein at least one of said first dispensing container and said disposal container is replaceable.

4. A unit as recited by claim 1, wherein said first dispensing container further comprises a closure.

5. A unit as recited by claim 1, wherein said first dispensing container is impervious.

6. A unit as recited by claim 1, wherein said personal hygiene wipes are pre-moistened.

7. A unit as recited by claim 6, wherein at least one agent selected from the group consisting of antibacterial, antiviral, antimicrobial, and antipathogenic agents is present in each of said pre-moistened, personal hygiene wipes.

8. A unit as recited by claim 1, wherein said pre-moistened, personal hygiene wipes are hypoallergenic.

9. A unit as recited by claim 6, wherein said pre-moistened, personal hygiene wipes are inter-folded.

10. A unit as recited by claim 6, wherein said pre-moistened, personal hygiene wipes are supplied from a roll having serrations.

11. A unit as recited by claim 1, wherein said disposal container is composed of an impervious material.

12. A unit as recited by claim 1, wherein said disposal container comprises an impervious liner.

13. A unit as recited by claim 1, further comprising a lid.

14. A unit as recited by claim 1, further comprising at least one storage compartment.

15. A unit as recited by claim 1, further comprising a bottom openably connected to said housing.

16. A unit as recited by claim 15, further comprising locking means adapted to secure said bottom to said housing.

17. A unit as recited by claim 1, further comprising a top openably connected to said housing.

18. A unit as recited by claim 1, further comprising a warming element adapted to warm said personal hygiene wipes provided in said first dispensing container.

* * * * *